United States Patent [19]

Sugiura et al.

[11] 4,116,874

[45] Sep. 26, 1978

[54] COMPRESSOR OIL COMPOSITIONS

[75] Inventors: Kensuke Sugiura; Toru Miyagawa, both of Kawasaki; Haruo Seki, Yokohama, all of Japan

[73] Assignee: Nippon Oil Co., Ltd., Tokyo, Japan

[21] Appl. No.: 809,069

[22] Filed: Jun. 22, 1977

Related U.S. Application Data

[63] Continuation of Ser. No. 718,319, Aug. 27, 1976, abandoned.

[30] Foreign Application Priority Data

Aug. 27, 1975 [JP] Japan ..... 50-103054

[51] Int. Cl.[2] ..... C10M 1/48; C10M 3/42; C10M 5/24; C10M 7/46

[52] U.S. Cl. ..... 252/46.7; 252/50; 252/400 A

[58] Field of Search ..... 252/46.7, 400 A, 50

[56] References Cited

U.S. PATENT DOCUMENTS

| | | | |
|---|---|---|---|
| 2,730,499 | 1/1956 | Pokorny | 252/46.7 |
| 3,198,736 | 8/1965 | Henderson | 252/46.7 |
| 3,297,574 | 1/1967 | MacPhail et al. | 252/46.7 |
| 3,544,465 | 12/1970 | Braid | 252/46.7 |
| 3,850,824 | 11/1974 | Nebzydoski et al. | 252/46.7 |
| 3,909,425 | 9/1975 | Crawford et al. | 252/32.7 E |

*Primary Examiner*—Irving Vaughn
*Attorney, Agent, or Firm*—Wenderoth, Lind & Ponack

[57] ABSTRACT

A compressor oil composition comprising a major proportion of a lubrication base oil, and a minor proportion of (a) an aromatic amine, (b) an alkylphenol and (c) a triester of dithiophosphoric acid as essential ingredients.

6 Claims, No Drawings

COMPRESSOR OIL COMPOSITIONS

This is a continuation of application Ser. No. 718,319 filed Aug. 27, 1976 now abandoned.

BACKGROUND OF THE INVENTION

This invention relates to a compressor oil composition having excellent oxidation stability.

Compressor oils are generally used in compressors for their action of cooling by removing the heat generated by adiabatic compression, action of lubricating bearing and other parts, and action of sealing to prevent gas leakage at sliding parts. Gases to be compressed include, for example, air, oxygen, carbon dioxide, nitrogen, hydrogen, hydrocarbons, chlorine, and ammonia. Air compressors are used most frequently, and impose the most severe oxidizing conditions on compressor oils.

Within the air compressors, the most severe oxidizing conditions for compressor oils are set up owing to the presence of high-temperature high-pressure air, the presence of metals performing a catalytic action on oxidation such as copper or iron, and the presence of condensed water generated by compression, etc. For this reason, when an ordinary turbine oil, engine oil, or hydraulic actuating oil, etc. is used as the compressor oil, the oil is oxidatively deteriorated within very short periods of time, and at the same time, serious troubles such as the formation of sludge or the corrosion of a copper-containing material are caused. Once such a phenomenon has occurred, the original state cannot be restored unless the compressor is overhauled or cleaned completely. The cost and time required for this procedure would be enormous.

A great number of compounds such as aromatic amines, alkylphenols, zinc dialkyldithiophosphates or zinc dithiocarbamate have been known and commercially used as antioxidants to be added to lubricating oils. However, when such a compound is used alone in mineral lubricating oils for compressors, the oils are oxidatively deteriorated within short periods of time and become useless.

Combinations of these antioxidant compounds are also disclosed, for example, in Japanese Patent Publication No. 17615/61, Japanese Laid-Open Patent Publication No. 91462/73, U.S. Pat. No. 2,739,122, and DAS 1,594,405, but have not proved entirely satisfactory.

It is an object of this invention therefore to provide a lubricating oil composition for compressors having excellent oxidation stability, which has a much longer life under oxidation conditions than in the case of using conventional antioxidants for compressor oils, and which even when oxidatively deteriorated, is scarcely likely to cause serious troubles such as the formation of sludge.

SUMMARY OF THE INVENTION

The present invention provides a compressor oil composition, which comprises a major proportion of a lubricating base oil, and a minor proportion of (a) an aromatic amine, (b) an alkylphenol and (c) a triester of dithiophosphoric acid as essential ingredients.

The composition of this invention is characterized in that its acid number does not increase appreciably after use, it has a long life under oxidation conditions, and the color of the oil after use is satisfactory.

DETAILED DESCRIPTION OF THE INVENTION

The composition of this invention comprises a majo proportion of a lubricating base oil and a minor propor tion of an aromatic amine, an alkylphenol and a trieste of dithiophosphoric acid.

The lubricating base oil that can be used in this inven tion includes, for example, mineral lubricating oils hav ing a viscosity at 37.8° C. of 20 to 100 centistokes, pref erably 30 to 50 centistokes, refined products thereof and synthetic hydrocarbon oils having a viscosity a 37.8° C. of 20 to 100 centistokes.

Aromatic amines that can be used in the compositio of this invention include compounds of the followin formula $$R_1 - NH - R_2$$

wherein $R_1$ and $R_2$, identical or different, represent a aryl group containing 6 to 18 carbon atoms, or an alka ryl group, compounds of the following formula

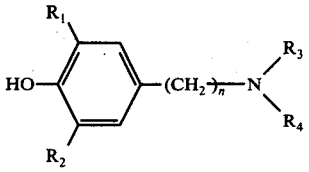

wherein $R_1$, $R_2$, $R_3$ and $R_4$, identical or different represent an alkyl group containing 1 to 4 carbo atoms, and $n$ is 1 to 4, and compounds of the fol lowing formula

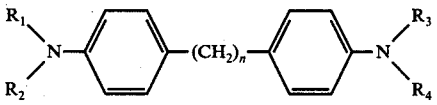

wherein $R_1$, $R_2$, $R_3$ and $R_4$, identical or different represent an alkyl group containing 1 to 4 carbo atoms, and $n$ is 1 to 4.

Specific examples of the aromatic amines are diphe nylamine, phenyl-α-naphthylamine, phenyl-β-naph thylamine, phenyl-p-octylphenylamine, p,p'-dioctyldi phenylamine, 2,6-di-tert.-butyl-α-dimethylamino-p cresol, and tetramethyldiaminodiphenylmethane. O these, the phenyl-α-naphthylamine and diphenylamin are especially preferred.

Alkylphenols that can be used in the composition o this invention include compounds of the following for mula

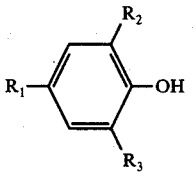

wherein $R_1$, $R_2$ and $R_3$, identical or different, repre sent an alkyl group containing 1 to 4 carbon atom compounds of the formula

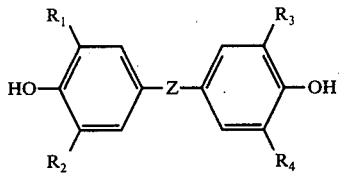

wherein $R_1$, $R_2$, $R_3$ and $R_4$, identical or different, represent an alkyl group containing 1 to 4 carbon atoms, and Z represents, for example, $-(CH_2)_n$, $n$ being 0 to 4, —S—, —S—S—, or $-CH_2-S-CH_2-$, and compounds of the following formula

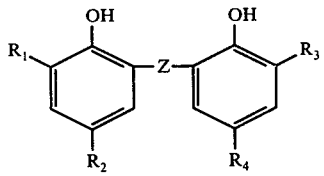

wherein $R_1$, $R_2$, $R_3$ and $R_4$, identical or different, represent an alkyl group containing 1 to 4 carbon atoms, and Z represents, for example, $(CH_2)_n$, $n$ being 0 to 4, —S—, —S—S—, or $-CH_2-S-CH_2-$.

Specific examples of the alkylphenols are 2,6-di-tert.-butyl-p-cresol, 4,4'-methylenebis(2,6-di-tert.-butylphenol), 4,4'-dihydroxy-3,3',5,5'-tetra-tert.-butylbiphenyl, 4,4'-thiobis(2,6-di-tert.-butylphenol), bis(3,5-di-tert.-butyl-4-hydroxybenzyl) sulfide, and 2,2'-methylenebis(4-methyl-6-tert.-butylphenol). Of these, the 4,4'-methylenebis(2,6-di-tert.-butylphenol) and 2,6-di-tert.-butyl-p-cresol are especially preferred.

The triester of dithiophosphoric acid used in the composition of this invention is expressed by the following formula

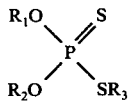

wherein $R_1$, $R_2$ and $R_3$, identical or different, represent an alkyl group containing 1 to 18 carbon atoms, an aryl group, an alkaryl group or an aralkyl group.

Examples of the triester of dithiophosphoric acid include S-dodecyl O,O'-dipropyl dithiophosphate, O,O'-bis(propylphenyl)-S-benzyl dithiophosphate, and O,O'-bis(propylphenyl)-S-styryl dithiophosphate. Of these, the O,O'-bis(propylphenyl)-S-styryl dithiophosphate and O,O'-bis(propylphenyl)-S-benzyl dithiophosphate are preferred. The O,O'-bis(propylphenyl)-S-benzyl dithiophosphate is especially preferred.

Each of the three kinds of additives in this invention is used in an amount of 0.01 to 3.0% by weight, preferably 0.03 to 1.0% by weight, based on the total amount of the lubricating oil composition. Especially preferred amounts are 0.05 to 0.3% by weight for the aromatic amine (a), 0.05 to 0.2% by weight for the alkylphenol (b), and 0.03 to 0.2% by weight for the triester of dithiophosphoric acid (c).

If desired, the lubricating oil composition of this invention may further contain a dispersant, a metal deactivator, a rust inhibitor, an antifoamer, or a pour point depressant in addition to the three kinds of additives described above.

The composition of this invention is characterized by a reduced degree of increase in acid number after use and a long service life under oxidation conditions. In particular, when used under severe oxidation conditions, the composition of this invention exhibits a long life and an excellent performance.

The following Examples and Comparative Examples illustrate the present invention without any intention of limiting it.

EXAMPLES 1 TO 3

Various additives in the amounts shown in Table 1 were added to a mineral lubricating oil base having a viscosity of 35.0 centistokes at 37.8° C. to form compressor oil compositions.

In the table, 2,5-dimercapto-1,3,4-thiadiazole and benzotriazole are metal deactivators; a hemiester of an alkenylsuccinic acid, a rust inhibitor; and a silicon oil, an antifoamer.

The performances of the lubricating oil compositions were evaluated by an oxidation test in a rotary vane-type air compressor, an Indiana stirring oxidation test, a rotating bomb-type oxidation test (ASTM D2272), and a turbine oil oxidation stability test stipulated in JIS (Japanese Industrial Standards) K2515.

The results are shown in Table 1.

When a service is performed for 2,000 hours using a rotary vane-type air compressor, the acid number of the lubricating composition after testing is preferably not more than 0.15 mg KOH/g, particularly not more than 0.10 mg KOH/g.

When the Indiana stirring oxidation test is performed at 165.5° C. for 48 hours, the acid number of the lubricating oil composition after testing is preferably not more than 0.25 mg KOH/g, particularly not more than 0.10 mg KOH/g.

In the rotating bomb type oxidation test, the life of the lubricating oil composition under oxidation conditions is preferably at least 450 minutes, especially longer than 600 minutes.

In the turbine oil oxidation stability test (JIS K2515), the lubricating oil composition preferably attains an acid number of 1.0 mg KOH/g in at least 4,000 hours, particularly in at least 5,500 hours, after initiation of the test. On the other hand, the color (union value) of the lubricating oil composition at the end of 2,000 hours in this test is preferably 5 or below.

It can be seen from Table 1 that the compositions in accordance with Examples 1 to 3 exhibited superior results in all of these tests, and the composition of Example 3 gave especially superior results.

COMPARATIVE EXAMPLES 1 TO 10

Lubricating oil compositions were prepared in accordance with the recipes shown in Table 1, and tested in the same manner as in Examples 1 to 3. The results are also shown in Table 1.

Table 1

(Unit: % by weight)

| | | Examples | | | Comparative Examples | | | | | | | | | |
|---|---|---|---|---|---|---|---|---|---|---|---|---|---|---|
| | | 1 | 2 | 3 | 1 | 2 | 3 | 4 | 5 | 6 | 7 | 8 | 9 | 10 |
| (a) | Diphenylamine | | 0.1 | 0.5 | 1.0 | | | | | | | 0.5 | 0.3 | |
| | Phenyl-α-naphthylamine | 0.2 | | | | | | | 0.5 | | | | | 0.2 |
| | 2,6-Di-tert.-butyl-p-cresol | | 0.1 | | | 1.0 | | | | | 0.3 | | | 0.3 |
| (b) | 4,4'-Methylenebis(2,6-di-tert.-butylphenol) | 0.1 | | 0.2 | | | | | 0.5 | 0.3 | | | 0.3 | |
| | Zinc di-4-methylpentyl dithiophosphate | | | | | | 1.0 | | | 0.5 | 0.3 | | 0.1 | 0.1 |
| (c) | O,O'-bis(propylphenyl)-S-benzyl dithiophosphate | | | 0.2 | | | | | | | | 0.3 | | |
| | O,O'-bis(propylphenyl)-S-styryl dithiophosphate | 0.05 | 0.1 | | | | | 0.5 | | | | | | |
| other additives | 2,5-Dimercapto-1,3,4-thiodiazole | | 0.05 | | 0.05 | | | | 0.05 | 0.05 | | | 0.05 | |
| | Benzotriazole | 0.005 | | | | | 0.01 | 0.01 | | | 0.01 | 0.01 | | |
| | Hemiester of alkenylsuccinic acid | 0.3 | 0.3 | | 0.05 | 0.05 | 0.05 | 0.05 | 0.03 | 0.03 | 0.03 | 0.03 | 0.05 | |
| | Silicone oil | 0.002 | 0.002 | | 0.002 | 0.002 | 0.002 | 0.002 | 0.002 | 0.003 | 0.002 | 0.002 | 0.002 | |
| Acid value after service test (mg KOH'g) | Rotary vane-type air compressor (2,000 hours) | 0.05 | 0.11 | 0.06 | 2.0 | 3.0 | 1.5 | 2.4 | 0.5 | 0.10 | 0.22 | 0.20 | 0.11 | 0.15 |
| | Indiana stirring oxidation test (48 hours at 165.5° C.) | 0.12 | 0.22 | 0.10 | 7.5 | 10.0 | 0.25 | 0.15 | 0.45 | 0.15 | 0.35 | 0.15 | 0.11 | 0.18 |
| Rotating bomb-type oxidation test (life in minutes) | | 570 | 480 | 650 | 550 | 250 | 50 | 50 | 580 | 200 | 180 | 600 | 600 | 550 |
| Turbine oil oxidaton stability test | Time until the acid value reached 1.0 mg KOH/g (hours) | 5300 | 4900 | 5600 | 2900 | 2500 | 1000# | 1100# | 2900 | 2000 | 1800# | 2700 | 3200 | 2800 |
| | Color (union value) at 2,000 hours | 4 | 4½ | 4 | 8 | 4 | 6* | 6* | 7 | 6 | 6½* | 6½ | 6½ | 7 |

*The life did not reach 2,000 hours. Therefore, the color of the composition immediately before breakdown is given. The breakdown time is indicated by symbol #.

The results shown in Table 1 demonstrate the following facts. The lubricating oil compositions containing only one antioxidant component (Comparative Examples 1 to 4) showed unsatisfactory results in all the tests. The compositions containing two of the antioxidant components (Comparative Examples 5 to 8) were improved over the compositions in Comparative Examples 1 to 4, but were still unsatisfactory. The lubricating oil compositions containing three components but using zinc di-4-methylpentyl dithiophosphate as a component corresponding to component (c) in the present invention exhibited considerably improved results over the use of two antioxidant components, but proved unsatisfactory in the turbine oil oxidation stability test (JIS K2515).

In contrast, the lubricating oil compositions in accordance with this invention (Examples 1 to 3, particularly Example 3) exhibited superior performances in all of these tests.

What we claim is:

1. A compressor oil composition comprising (A) a major proportion of a lubricating base oil selected from the group consisting of refined products of mineral lubricating oils having a viscosity at 37.8° C. of 20 to 100 centistokes and synthetic hydrocarbon oils having a viscosity at 37.8° C of 20 to 100 centistokes, and (B) 0.01 to 3.0% by weight, based on the total weight of the compressor oil composition, of each of (a) an aromatic amine selected from the group consisting of diphenylamine, phenyl-α-naphthylamine, phenyl-β-naphthylamine, phenyl-p-octylphenylamine, p,p'-dioctyldiphenylamine, 2,6-ditert.-butyl-α-dimethylamino-p-cresol and tetramethyldiaminodiphenylmethane, (b) ai alkylphenol selected from the group consisting of 2,6 di-tert.-butyl-p-cresol, 4,4'-methylenebis(2,6-di-tert. butylphenol), 4,4'-dihydroxy-3,3',5,5'-tetratert.-buty biphenyl, 4,4'-thiobis(2,6-di-tert.-butylphenol), bis(3,5 di-tert.-butyl-4-hydroxybenzyl) sulfide and 2,2' methylenebis(4-methyl-6-tert.-butylphenol), and (c) a triester of dithiophosphoric acid selected from th group consisting of S-dodecyl O,O'-dipropyl dithio phosphate, O,O'-bis(propylphenyl)-S-benzyl dithio phosphate and O,O'-bis(propylphenyl)-S-styryl dithio phosphate.

2. The composition of claim 1 wherein the amount o each of the components (a), (b) and (c) is 0.03 to 1.0% by weight based on the total weight of the compresso oil composition.

3. The composition of claim 1 which comprises 0.0 to 0.3% by weight of component (a), 0.05 to 0.2% b weight of component (b), and 0.03 to 0.2% by weight o component (c), based on the total weight of the com pressor oil composition.

4. The composition of claim 1 wherein the compo nent (a) is selected from the group consisting of diphe nylamine and phenyl-α-naphthylamine.

5. The composition of claim 1 wherein said compo nent (b) is selected from the group consisting of 4,4' methylenebis(2,6-di-tert.-butylphenol) and 2,6-di-tert. butyl-p-cresol.

6. The composition of claim 1 wherein said compo nent (c) is O,O'-bis(propylphenyl)-S-benzyl dithiophos phate.

* * * * *